US009580908B2

(12) United States Patent
Al-Salloum et al.

(10) Patent No.: US 9,580,908 B2
(45) Date of Patent: Feb. 28, 2017

(54) FIBER REINFORCED COMPOSITE SYSTEM FOR STRENGTHENING OF WALL-LIKE RC COLUMNS AND METHODS FOR PREPARING SUCH SYSTEM

(71) Applicant: King Saud University, Riyadh (SA)

(72) Inventors: Yousef A. Al-Salloum, Riyadh (SA); Husain Abbas, Riyadh (SA); Saleh H. Alsayed, Riyadh (SA); Nadeem A. Siddiqui, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 14/539,038

(22) Filed: Nov. 12, 2014

(65) Prior Publication Data

US 2016/0130813 A1 May 12, 2016

(51) Int. Cl.

| | |
|---|---|
| ***E04C 1/40*** | (2006.01) |
| ***E04C 3/34*** | (2006.01) |
| ***E04C 3/36*** | (2006.01) |
| ***E04C 5/01*** | (2006.01) |
| ***E04C 5/07*** | (2006.01) |
| ***E02D 5/22*** | (2006.01) |
| ***E02D 5/60*** | (2006.01) |

(52) U.S. Cl.

CPC ..... *E04C 3/34* (2013.01); *E02D 5/226* (2013.01); *E02D 5/60* (2013.01); *E04C 3/36* (2013.01); *E04C 5/01* (2013.01); *E04C 5/073* (2013.01)

(58) Field of Classification Search

CPC ..... E04C 2/06; E04C 3/20; E04C 3/26; E04C 3/30; E04C 3/34; E04C 3/36; E04C 3/44; E04C 5/01; E04C 5/07; E04C 5/073; E04C 5/08; E01D 2101/28; E02D 5/60; E02D 5/226; E04G 21/12

USPC ..... 52/223.4, 223.7, 834

See application file for complete search history.

(56) References Cited

U.S. PATENT DOCUMENTS

| | | | | |
|---|---|---|---|---|
| 1,295,310 | A * | 2/1919 | Hartman | E04G 13/021 249/102 |
| 3,350,049 | A * | 10/1967 | Reiland | 249/48 |
| 4,426,813 | A * | 1/1984 | Buzzi, Jr. | 52/27 |
| 6,219,986 | B1 * | 4/2001 | Ouchi | E04G 23/0218 52/425 |
| 6,247,279 | B1 | 6/2001 | Murat et al. | |
| 6,363,681 | B1 | 4/2002 | Neuner | |
| 6,832,454 | B1 | 12/2004 | Iyer | |

(Continued)

*Primary Examiner* — Patrick Maestri

(74) *Attorney, Agent, or Firm* — Hauptman Ham, LLP

(57) ABSTRACT

A shape modification of a wall-like column includes the preparation of the column by chamfering the corners and roughening the sides of cement segments thereto. The process requires a simple formwork in the form of generally circular PVC pipe segments which are cut to required shapes which are arcuate such as the segments of a circle, oval or even elliptical. After those forms formed from the PVC pipe affixed around the reinforced concrete column are then filled with grout/cement. A plurality of vertical steel strips are attached to the column by steel rod-like shear studs that extend through previously drilled passageways passing through the reinforced concrete column and segments. The reinforced concrete column is then strengthened by increasing the area of cross section and more importantly by confining the column and attached segments by FRP materials. In addition, the vertical strips with steel studs contribute to the column strengthening.

3 Claims, 4 Drawing Sheets

Cross-section of a wall-like column with aspect ratio of 3 to 5

(56) References Cited

U.S. PATENT DOCUMENTS

| | | | | |
|---|---|---|---|---|
| 7,811,495 | B2 | 10/2010 | Dagher et al. | |
| 2006/0070338 | A1 | 4/2006 | Pantelides et al. | |
| 2006/0174549 | A1* | 8/2006 | Dagher et al. | 52/86 |
| 2014/0053494 | A1* | 2/2014 | Russell | E04C 3/08 52/660 |

* cited by examiner

Cross-section of a wall-like column with aspect ratio of 3 to 5

Surface preparation and drilling of holes in column

Column with PVC pipe and cement grouting

PVC pipes being removed after hardening of cement grout/concrete

FRP affixed to shape-modified column

Final cross-section of strengthened column after fixing shear studs on vertical steel strips

Strengthening of wall-like RC columns with aspect ratios of 2 to 3 using FRP wrapping

Variables used in the formula for preliminary proportioning of the sizes of circular, oval, or elliptical bulbs

FIBER REINFORCED COMPOSITE SYSTEM FOR STRENGTHENING OF WALL-LIKE RC COLUMNS AND METHODS FOR PREPARING SUCH SYSTEM

FIELD OF THE INVENTION

This invention relates to the strengthening of wall-like reinforced concrete (RC) columns using fiber reinforced polymer material surrounding the columns after shape modification employing a plurality of segments.

BACKGROUND OF THE INVENTION

The use of reinforced concrete columns of various shapes for carrying vertical loads is well known and widely practiced. However, strengthening and/or rehabilitation of such columns is often required to eliminate structural problems resulting from unusual loading, exposure to aggressive environment, aging, inadequate design and/or poor construction. Upgrading of the columns with fiber reinforced polymer (FRP) sheets is a well-known technique for repair and rehabilitation by placing the fibers mainly transverse to the longitudinal axis of the columns.

It has been recognized that the effectiveness of the FRP confinement in delaying and limiting unstable crack propagation depends to a large degree on the stiffness of the FRP jacket. However, it is also well known that the use of FRP confining systems for columns with a rectangular cross section is less effective than on a circular cross section due to a part of the cross sections remaining unconfined and that the effectiveness depends on the sharpness of corners. In addition, it is well known that the confinement provided by FRP to the confined concrete in a rectangular shaped column is reduced as the aspect ratio increases. In fact, the benefit of FRP wrapping in terms of ductility should be neglected if the aspect ratio is more than 1.5.

A U.S. Patent Publication No. 2006/0070338 in the name of Pantelides et al. discloses Shape Modification and Reinforcement of Columns Confined with FRP Composites. As disclosed, FRP composites have a number of advantages over steel, including their high strength-to-weight ratio and excellent durability. The confinement effectiveness of FRP materials for rectangular sections can be improved by performing shape modification such that a rectangular column section is modified into a shape that does not have 90 degree corners such as an elliptical, oval or circular column. An expansive concrete can be advantageously used between the FRP material and the existing concrete in order to post-tension the FRP material circumferentially and improve confinement of the concrete. A finite element analytical model is also disclosed which describes the stress-strain relationship for the FRP-confined columns after shape modification.

Notwithstanding the above, it is presently believed that there is a need and a potential commercial market for an improved shaped modification of wall-like rectangular reinforced concrete columns in accordance with the present invention.

SUMMARY OF THE INVENTION

In essence, the present invention contemplates shape modification of wall-like rectangular columns for improved confinement provided by multiple circular segment bulb sections. The process of strengthening requires a simple framework in the form of a generally semicircular PVC pipes which are cut to required shapes in the form of segments of a circle. The cement grout is added to the space between the pipes and the column. After the hardening of cement grout, the PVC pipes are removed and an FRP sheet is affixed to the modified column shape i.e. column plus segments.

An important aspect of the present invention resides in the use of vertical steel strips attached to the column by steel studs. The steel studs pass through the column through passages made in the column and FRP sheets as well as the steel strips. The column strengthening is achieved by increasing the area of the cross section and more importantly by confinement of a column by FRP materials. In addition, the vertical steel strips with steel studs also contribute to column strengthening.

To be more specific, a fiber reinforced composite structure comprises or consists of the following.

A reinforced concrete column having a wall-like rectangular cross section with an aspect ratio (length of the wall to thickness of the wall) of greater than 1.5:1, a plurality of arcuate cement segments disposed on each side and the ends of the wall-like rectangular column and a plurality of passages extending through the column and one or more segments.

The invention further comprises or consists of a plurality of vertical steel strips with one of the steel strips between adjacent arcuate segments on each side of the wall-like rectangular column.

In addition, the invention includes a plurality of steel rod like shear studs.

A further embodiment of the invention contemplates a method for strengthening wall-like rectangular reinforced concrete columns by shape modification using reinforced polymer materials.

The method in accordance with the present invention comprises or consists of the following steps.

In a first step, a reinforced rectangular wall-like concrete column is surrounded by a plurality of arcuate segments formed by a plastic pipe or the like placed against the column and filled with grout. The arcuate segments may have a semicircular shape with a plurality of segments on each side of the column and with a series of at least two generally vertical segments on each side of the wall-like column aligned with an equal number of segments on an opposite side of the wall-like column.

The spaces between the semicircular plastic form and the rectangular column are filled with grout and after hardening the plastic forms (pipes) are removed. In a preferred embodiment of the invention, there is a relatively small space between adjacent segments on each side of the wall-like column that are filled with grout and connect or join adjacent segments together.

A plurality of passages extend through the rectangular wall-like columns, the arcuate segments or connections join the adjacent segment together as well as through a number of steel strips.

In addition, a plurality of steel strips are provided with openings aligned with the passageways and placed with the openings therein aligned with the passageway and with the steel strips vertically aligned between the arcuate segments. A plurality of steel bolts are used to maintain the steel strips and arcuate segments together under compression.

Sheets of fiber reinforced polymer material is then wrapped around the wall-like columns and arcuate segments with the fibers under tension to thereby reinforce the wall-like rectangular column.

It should be recognized that the FRP material can include a fiber and polymeric matrix. Typically fibers can include but are not limited to glass fiber, carbon fiber and aramid fiber or combinations thereof. Glass and carbon fibers tend to be cost effective and provide good mechanical properties. Aramid fibers are light, durable and are known to have high tenacity. The section of the fibers can be based on factors such as costs, strength, rigidity and long-term stability. Additionally, each type of fiber offers different performance characteristics and suitability for various applications. For example, aramids may come in low, high and very high modulus configurations. Carbon fibers are also available with a large range of moduli, with upper limits nearly four times that of steel. Of the several glass fiber types glass-based FRP reinforcement is least expensive and generally uses either E-glass or S-glass fibers. The fiber material for use in FRP can be provided as sheets which can be cut to a desired size or as length of fiber which can be wrapped and/or laid as desired to form a particular shape.

The polymeric resins used as the matrix for the fibers are usually thermosetting resins. Most available FRP materials are provided with polymeric resins such as polyesters, vinylesters or epoxies although other polymeric materials can also be used.

The invention will now be described in connection with the accompanying drawings wherein like reference numerals have been used to identify like parts.

DETAILED DESCRIPTION OF THE PREFERRED EMBODIMENTS OF THE INVENTION

Figure 1:
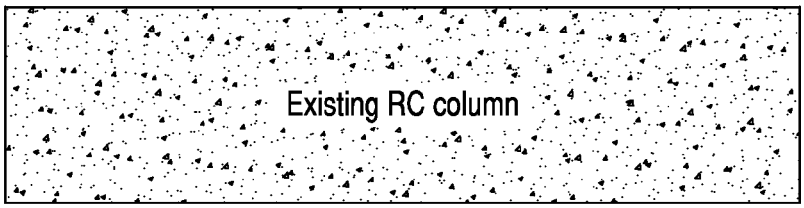
FIG. 1 is a cross sectional view of a wall-like column with an aspect ratio of 3 to 5:1 shown with an illustration of approximately 4:1.
Figure 2:
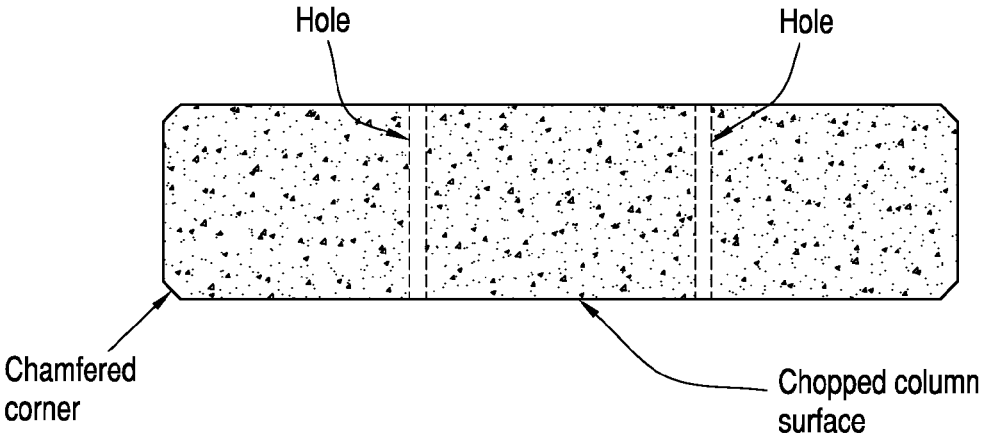
FIG. 2 is a cross sectional view of an existing reinforced concrete column illustrating the chipped surface and chamfered corners of the wall-like column shown in FIG. 1.
Figure 3:
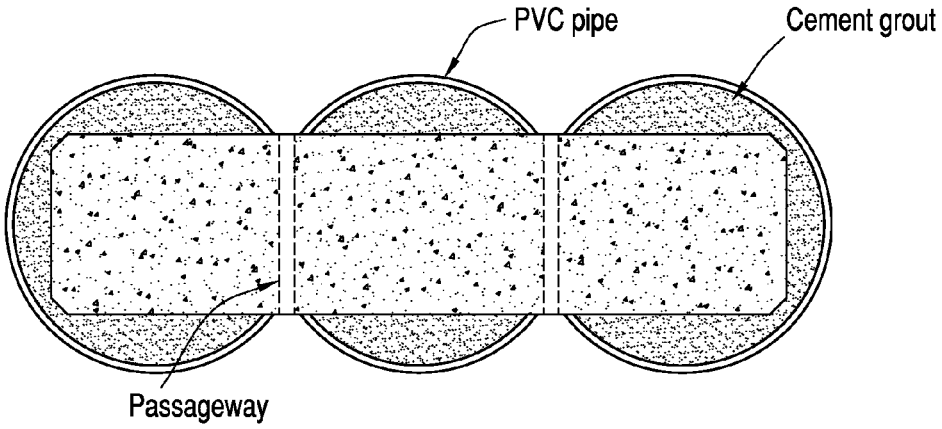
FIG. 3 is a schematic illustration of a reinforced concrete wall-like column with a plurality of PVC pipe segments surrounding the reinforced concrete column in accordance with the present invention.
Figure 4:
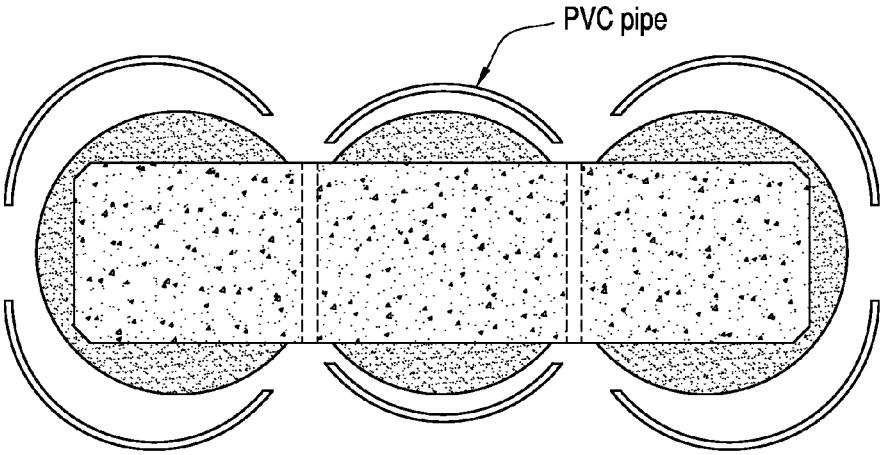
FIG. 4 is a schematic illustration of the reinforced concrete column shown in FIG. 3 with the arcuate segments of PVC pipe removed and the grout portions included after hardening.
Figure 5:
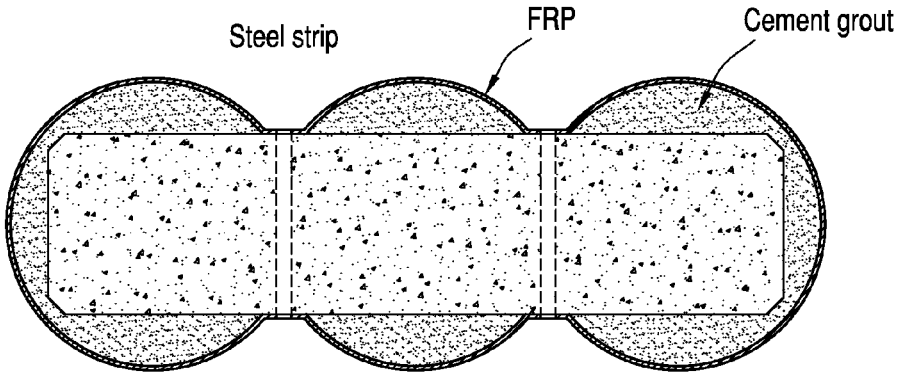
FIG. 5 is a schematic illustration of the reinforced concrete column with circular shaped segments fixed to the existing reinforced concrete column and in FRP sheets encircling the reinforced column.
Figure 6:
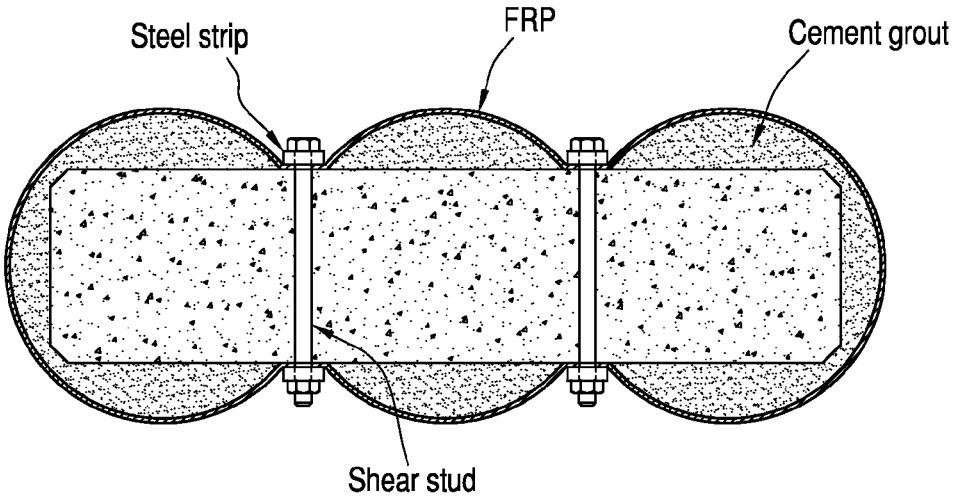
FIG. 6 is a schematic cross sectional view of a reinforced concrete column shown in the previous FIG. 5 showing the steel strips and rod-like shear studs and bolts for fastening the segments, FRP and column so that they are held together under compression.
Figure 7:
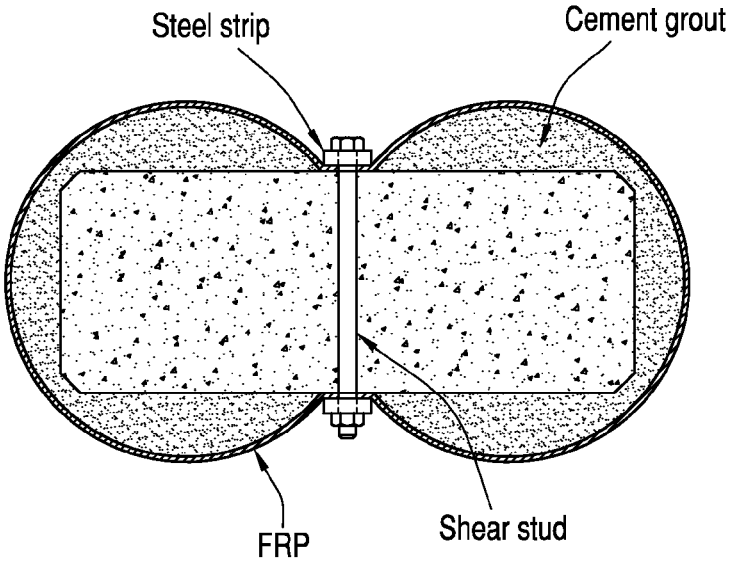
FIG. 7 is a second embodiment of the invention illustrating a pair of annular segments as used in one embodiment of the invention.
Figure 8:
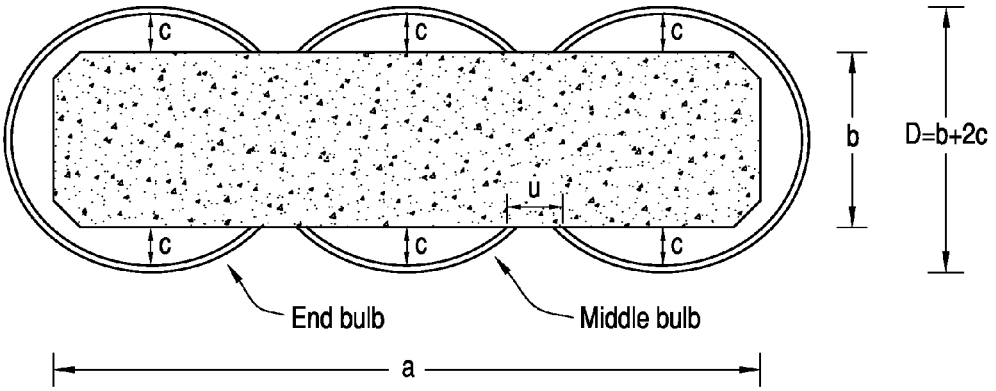
FIG. 8 is a schematic cross sectional view of a reinforced concrete column using a formula for preliminary proportioning of the sizes of circular segments.

The steps involved in the process of strengthening a rectangular wall-like reinforced concrete column comprise or consist of i) Planning the strengthening scheme to involve (a) the number and size of arcuate bulb sections, (b) strength and mix of cement grout/concrete, (c) type and number of FRP layers, (d) size of vertical steel strips, and (e) locations, diameter and spacing of shear studs.

ii) Marking the location of holes for shear studs on the surfaces of the column and then drill holes at marked locations in the column (FIG. 2). Trace/mark the location of holes on vertical steel strips and drill holes in the steel strips for the shear studs.

iii) Prepare the surface of the column which would involve chamfering of the corners (15 to 50 mm) and chipping/roughening the outer concrete surface of the column for the development of a good bond with the cement grout/concrete, as shown in FIGS. 3 and 4.

iv) Putting PVC pipes of the size of circular bulb sections and grout the spaces between pipes and the column using cement grout/concrete, as shown in FIG. 3. The shuttering oil may be applied on the inner surfaces of PVC pipes for the ease of their stripping. The concrete may be self-compacting type for proper filling. The diameter and offset for the middle circular bulb/bulbs is adjusted based on the column size and the diameter adopted for the end circular bulbs. Either one can use the same size PVC pipes for the middle circular bulb or any other suitable size based on the availability of space. The filling of spaces may require some holes to be drilled through PVC pipes through which cement grout/concrete may be poured. If the ends of a PVC pipe are tightly fitted so that escape of air may not be permitted then under such circumstances, some of the holes in the PVC pipes may also be used for the escape of air during pouring of cement grout/concrete.

v) After hardening of the cement grout/concrete, remove the PVC pipes for which the pipes at the ends of column cross-section are removed as shown in FIG. 5.

vi) Wrap and affix FRP sheet(s) over the shape-modified column, as shown in FIG. 6. Keep the overlap(s) inside the trough zones. FRP may be glass fiber reinforced polymer (GFRP) or carbon fiber reinforced polymer (CFRP) depending upon the design for strengthening. Textile reinforced mortar (TRM) may also be used in place of FRP.

vii) Place the vertical steel strips in position and drill holes through FRP sheets and then insert steel shear studs through these holes and tighten them with power wrench so as to get the final shape-modified strengthened column, as shown in FIG. 7. The column taken up for indicating the process of strengthening has an aspect ratio of 3 to 5. The columns with other ranges of aspect ratios may be similarly strengthened and one such column with an aspect ratio of 2 to 3 strengthened using the concept of the invention is shown in FIG. 7.

The commonly adopted method for the strengthening of wall-like rectangular RC columns using FRP confinement through shape modification involves the conversion of column cross-sections to generally elliptical shapes with a plurality of arc shapes on opposite sides of the column and oval shapes on each end. The confinement provided by FRP depends on the column offset used in shape modification. The more is the offset, more will be the confinement but there may be a limit to it due to the restriction on column width. Moreover, confinement provided by FRP to the elliptical or oval cross-sections is not uniform.

For rectangular columns of cross-section a×b with a being the longer side (i.e. a>b), the diameter of end circular bulbs, D, may be taken as (b+2c) where c is the maximum permissible column offset from the longer side of column cross-section (i.e. the thickness of cement grout). The value of c may however vary from 25 mm to b/2. For some cases, the column offset from shorter side of the column cross-section, which is usually not a major concern, may be more than the value of c. The diameter of middle circular bulb/bulbs may be kept the same as the end circular bulbs and the size of circular segment may be based on the space available after accommodating the end circular bulbs. For keeping the same magnitude of maximum column offset for each circular bulb, the diameter of middle circular bulb/bulbs may be varied. Alternatively, the diameter of bulbs. D may be decided using the following relation:

$$D = \sqrt{b^2 + \left[\frac{a}{n} - u\left(1 - \frac{1}{n}\right)\right]^2}$$

where n=number of bulbs; u=clear distance between adjoining mortar bulbs which is slightly more than the width of vertical steel strip between the adjoining bulbs due to the thickness of FRP sheet (u=βb). The value of maximum column offset, c, can be determined using: c=(D−b)/2. The above formula is based on the assumption of the same diameter of each bulb and the same magnitude of maximum column offset for each bulb. The number of bulbs may be taken to be approximately equal to the aspect ratio of column. The number of bulbs may however be lower or higher than the value of aspect ratio, α (α=a/b). It is worth mentioning here that, in general, the column offset may be reduced by increasing the number of bulbs. The value of u may vary from 25 to 100 mm. The use of the above formula for the preliminary proportioning of circular bulbs for the strengthening of wall-like columns is explained for several column cross sections in Tables 1 and 2. The column shown in FIG. 7 is Column-A2 (shown in bold in Table 1), whereas the column shown in FIGS. 1-7 is Column-B4 option 1 (shown in bold in Table 2).

The concrete mix (or cement grout) may be designed according to the design and construction requirements.

Though the patent is especially useful for wall like columns but the invention may be used for all rectangular column cross sections due to which Tables 1 and 2 cover a wide range of aspect ratios of column cross-sections.

TABLE 1

Preliminary proportioning of bulbs for different aspect ratios of columns with shorter side of column section, b, equal to 150 mm.

| | Column-A1 | Column-A2 | Column-A3 | Column-A4 (Option-1) | Column-A4 (Option-2) |
|---|---|---|---|---|---|
| Longer side of column section, a (mm) = | 150 | 400 | 500 | 700 | 700 |
| Shorter side of column section, b (mm) = | 150 | 150 | 150 | 150 | 150 |
| Aspect ratio of column section, α = a/b | 1.00 | 2.67 | 3.33 | 4.67 | 4.67 |
| Number of bulbs, n (assumed) = | 1 | 2 | 3 | 3 | 4 |
| Ratio of the width of steel strip in between the bulbs to the shorter side of column section, β (assumed) = | 0.25 | 0.25 | 0.25 | 0.25 | 0.25 |
| Clear distance between the adjoining mortar bulbs, u = β b (mm) = | 37.5 | 37.5 | 37.5 | 37.5 | 37.5 |
| Diameter of bulbs obtained using Eq. (1), D (mm) = | 212 | 235 | 206 | 257 | 210 |
| Column offset, c = (D − b)/2 (mm) = | 31 | 43 | 28 | 53 | 30 |

TABLE 2

Preliminary proportioning of bulbs for different aspect ratios of columns with shorter side of column section, b, equal to 200 mm.

| | Column-B1 | Column-B2 | Column-B3 | Column-B4 (Option-1) | Column-B4 (Option-2) |
|---|---|---|---|---|---|
| Longer side of column section, a (mm) = | 200 | 500 | 700 | 800 | 800 |
| Shorter side of column section, b (mm) = | 200 | 200 | 200 | 200 | 200 |
| Aspect ratio of column section, α = a/b | 1.00 | 2.50 | 3.50 | 4.00 | 4.00 |
| Number of bulbs, n (assumed) = | 1 | 2 | 3 | 3 | 4 |
| Ratio of the width of steel strip in between the bulbs to the shorter side of column section, β (assumed) = | 0.25 | 0.25 | 0.25 | 0.25 | 0.25 |

TABLE 2-continued

Preliminary proportioning of bulbs for different aspect ratios of columns with shorter side of column section, b, equal to 200 mm.

| | Column-B1 | Column-B2 | Column-B3 | Column-B4 (Option-1) | Column-B4 (Option-2) |
|---|---|---|---|---|---|
| Clear distance between the adjoining mortar bulbs, u = β b (mm) = | 50 | 50 | 50 | 50 | 50 |
| Diameter of bulbs obtained using Eq. (1), D (mm) = | 283 | 301 | 283 | 307 | 258 |
| Column offset, c = (D − b)/2 (mm) = | 41 | 51 | 41 | 54 | 29 |

While the invention has been described in connection with its accompanying drawings, it should be recognized that changes and modifications may be made therein without departing from the scope of the appended claims.

What is claimed is:

1. A fiber reinforced polymer composite structure comprising:

a reinforced concrete column having a rectangular cross section with a top, a bottom, two opposite sides and two ends and an aspect ratio of 1.5:1 (length of sidewalls to thickness between the sidewalls) or greater, chamfered corners, and two or more arcuate cement segments disposed on each of said two opposite sides of said column and a single segment disposed on each of said ends;

a fiber reinforced polymer material surrounding said column and said segments;

one or more perpendicular passages perpendicular to and through said fiber reinforced polymer material between adjacent segments on each of said opposite sides of said column; and a steel bolt extending through each of said one or more passages and a nut for fastening said column, said segments or segment and said fiber reinforced polymer together under compression;

in which each of said arcuate cement segments form a portion of a generally circular shape on said reinforced concrete column; and wherein an arcuate segment on each of said ends with an adjacent arcuate segment on each of said sidewalls form a semicircular shape abutting the two side and an end, and wherein the arcuate cement segments at the end are continuous over the reinforced concrete column and cover said chamfered corners at a predetermined depth.

2. The fiber reinforced polymer composite structure according to claim 1, in which a nut is attached to each of said bolts for fastening said column, said segments and said fiber reinforced polymer together under compression; and wherein for rectangular columns with a cross section of a×b with a>the diameter of the end circular bulb D may be taken as b+2c wherein c is the maximum permissible column offset from the longer side of the column cross section.

3. A method for strengthening rectangular reinforced concrete (RC) columns by shape modification using fiber reinforced polymer materials (RPM), said method comprising:

surrounding a rectangular reinforced concrete column with a plurality of plastic pipe segments forming one or more arcuate segments surrounding said column with a plurality of said segments on opposite sides thereof and in contact therewith;

filling voids formed between said arcuate plastic pipe segments and said column with grout;

hardening said grout form arcuate cement segments and wrapping said hardened segments and said column with fiber reinforced polymer materials (RPM);

forming one or more passageways through said column, said arcuate cement segments and said fiber reinforced polymer materials (RPM);

providing a steel bolt and steel nuts on opposite sides of said column for passing said steel bolt through said passageway and with said steel nuts on opposite sides of said column; and fastening steel studs on opposite sides of said column to hold said column, arcuate cement segments, and fiber reinforced polymer materials (RPM) together under compression; and wherein the diameter of the arcuate cement segment is based on the following formula $$D = \sqrt{b^2 + \left[\frac{a}{n} - u\left(1 - \frac{1}{n}\right)\right]^2}$$

wherein n=number bulbs; u=clear distance between adjoining mortar bulbs which is slightly more than the width of a vertical steel strip between the adjoining bulbs due to the thickness of FRP sheet and the value of maximum column offset c is determined using c=(D−b)/2 assuming the same distance of each bulb and the same magnitude of maximum column offset for each bulb.

* * * * *